United States Patent [19]

Stoll et al.

[11] 4,148,281

[45] Apr. 10, 1979

[54] STEAM GENERATOR AND PRESSURIZED-WATER NUCLEAR REACTORS

[75] Inventors: Alfred Stoll; Fritz Kelp, both of Erlangen, Fed. Rep. of Germany

[73] Assignee: Kraftwerk Union Aktiengesellschaft, Mulheim, Fed. Rep. of Germany

[21] Appl. No.: 778,592

[22] Filed: Mar. 17, 1977

[30] Foreign Application Priority Data

Mar. 22, 1976 [DE] Fed. Rep. of Germany ..... 2612081

[51] Int. Cl.[2] ..... F22B 1/02; F22B 37/24; F28F 7/00

[52] U.S. Cl. ..... 122/32; 165/82; 165/162; 122/510

[58] Field of Search ..... 122/32, 34, 510; 165/81, 82, 83, 158, 162, 163

[56] References Cited

U.S. PATENT DOCUMENTS

| | | | |
|---|---|---|---|
| 3,250,250 | 5/1966 | Heathcote | 122/34 |
| 3,443,548 | 5/1969 | Rich et al. | 165/81 |
| 3,596,638 | 8/1971 | Michel | 122/32 |
| 3,603,383 | 9/1971 | Michael et al. | 165/158 |
| 3,724,532 | 4/1973 | Sprague | 122/34 |
| 3,850,231 | 11/1974 | Creek | 122/32 |

*Primary Examiner*—Kenneth W. Sprague
*Attorney, Agent, or Firm*—Herbert L. Lerner

[57] ABSTRACT

Steam generator for pressurized-water nuclear reactors having a steam jacket wherein a multiplicity of rectilinear tubes traversed by primary water is secured between two horizontally disposed tube support plates, and at least one connecting tube for supplying the primary water is secured to the steam jacket through a compensator for length equalization, includes a water chamber respectively disposed within the steam jacket and adjoining each of the tube support plates, and a guide jacket for circulating feed-water supplied into the steam jacket, the guide jacket being mounted within the steam jacket and having a lower portion extending into a space located between the steam jacket and the lower tube support plate.

4 Claims, 3 Drawing Figures

STEAM GENERATOR AND PRESSURIZED-WATER NUCLEAR REACTORS

Figure 1:
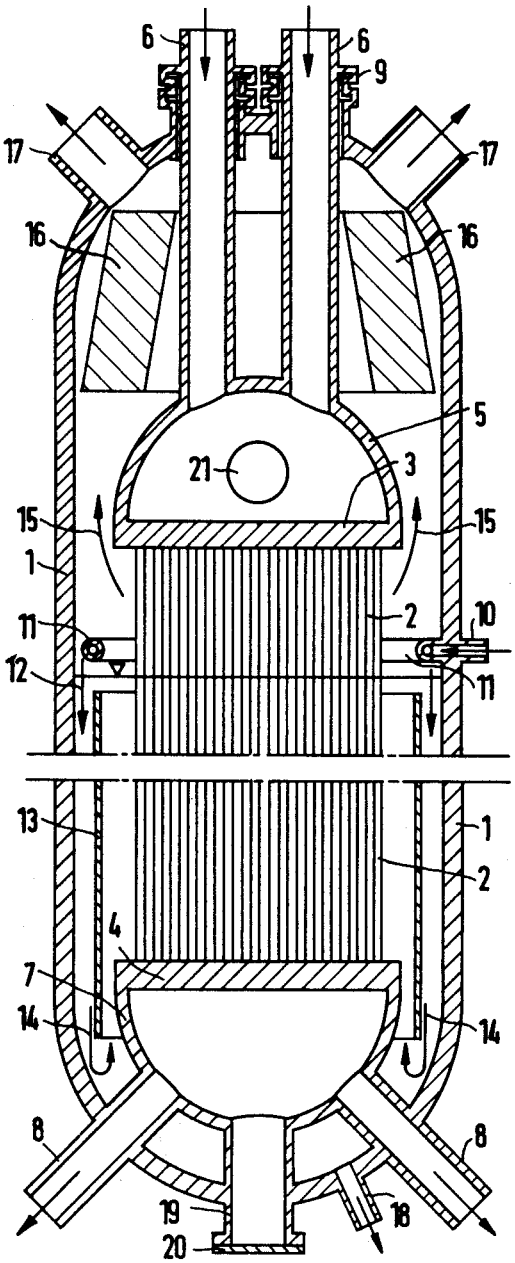

The invention relates to a steam generator for pressurized-water nuclear reactors.

In a nuclear reactor of this general type, primary water under high pressure is employed as coolant for the fuel elements. The primary water is conducted through vaporizer tubes in a tube heat exchanger. The vaporizer tubes are located at least in part within a chamber or space filled with the water that is to be vaporized.

Such a steam generator is described in German Published Non-Prosecuted Application DT-OS 1 551 050 and contains vaporizer tubes traversed by primary water and located between two tube support plates. The lower tube support plate is firmly connected at the periphery thereof to the steam jacket forming the housing for the steam generator. The longitudinal expansion of the connecting piece or pipe for the primary water, which is connected to a water chamber, is afforded by means of a compensator disposed between the connecting pipe and the steam jacket.

Such steam generators require at least one tube support plate firmly or rigidly connected at the periphery thereof to the steam jacket and having dimensions considerably greater than those of a displaceable tube support plate which solely encompasses the space for fastening the tubes traversed by the primary water and the adjoining water chamber. The tube support plates represents, in such apparatus, the most difficult forging which, due to dimensioning and weight signifies or denotes the limit of manufacturing technology.

It has been found, after lengthy operating period, that corrosion products deposit on the upper side of the tube support plates in steam generators having horizontal tube support plates that are firmly connected at the periphery thereof to the steam jacket, especially in such steam generators having U-shaped tubes traversed by primary water and wherein feedwater circulates between the steam jacket and a guide jacket. Such corrosion products can cause tube damage and are difficult to remove because they settle in the gaps between the tubes. The deposit of these corrosion products results from the issuance in horizontal direction of the feedwater at considerable velocity from openings in the guide jacket, with the tube support plates firmly connected at the periphery thereof to the steam jacket and the feedwater flows into the tube system in this horizontal direction.

It is an object of the invention to provide a steam generator for pressurized-water nuclear reactors that is furnished with rectilinear vaporizer tubes whereby impurities in the water to be vaporized are able to be removed easily and wherein the production costs both for the steam jacket as well as for the tube support plates are considerably reduced over conventional steam jackets and tube support plates. This minimal expense is primarily afforded in the steam generator of the invention by the fact that the diameter of the tube support plates can be kept smaller than the diameter of the steam jacket and that, nevertheless, no varying steam-jacket diameters are required.

With the foregoing and other objects in view, there is provided, in accordance with the invention, a steam generator for pressurized-water nuclear reactors having a steam jacket wherein a multiplicity of rectilinear tubes traversed by primary water is secured between two horizontally disposed tube support plates, and at least one connecting tube for supplying the primary water is secured to the steam jacket through a compensator for length equalization, comprising a water chamber respectively, disposed within the steam jacket and adjoining each of the tube support plates, and a guide jacket for circulating feedwater supplied into the steam jacket, the guide jacket being mounted within the steam jacket and having a lower portion extending into a space located between the steam jacket and the lower tube support plate. In accordance with another feature of the invention, the water chamber adjoining the lower tube support plate and a lower part of the steam jacket define an intermediate space, and a waste liquid connecting pipe communicates with the intermediate space and extends from the steam jacket.

In accordance with a further feature of the invention, the steam jacket has a uniform diameter over a middle portion thereof that exceeds the diameter of the tube support plates to an extent that annular spaces defined by the tube support plates, on the one hand, and the middle portion of the steam jacket, on the other hand, are formed through which adequate volumes of feedwater and steam can flow.

In accordance with a concomitant feature of the invention, a plurality of parallel-connected connecting tubes for supplying the primary water and a plurality of parallel-connected connecting tubes for discharging the primary water are connected to the steam jacket.

Other features which are considered as characteristic for the invention are set forth in the appended claims.

Although the invention is illustrated and described herein as embodied in steam generator for pressurized-water nuclear reactors, it is nevertheless not intended to be limited to the details shown, since various modifications and structural changes may be made therein without departing from the spirit of the invention and within the scope and range of equivalents of the claims.

Figure 2:
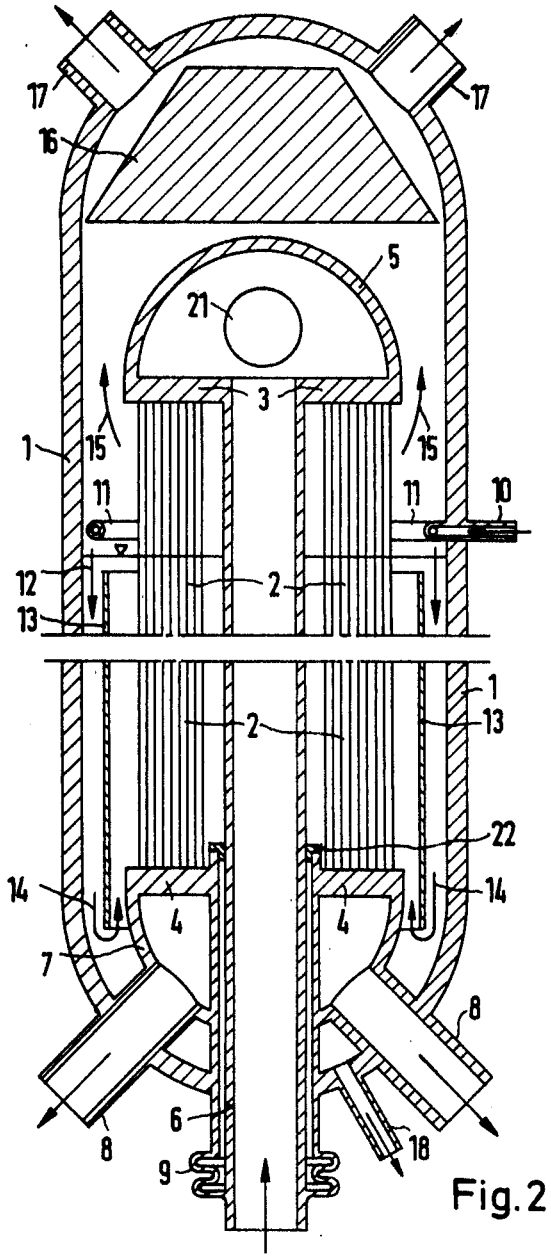
Figure 3:
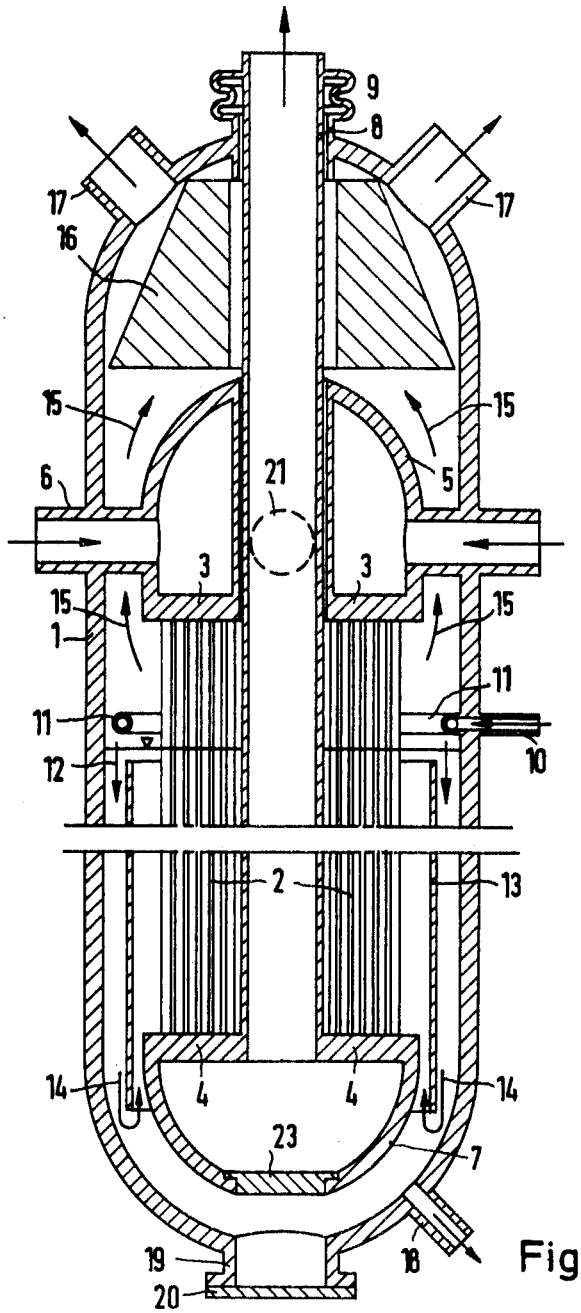

The construction and method of operation of the invention, however, together with additional objects and advantages thereof will be best understood from the following description of specific embodiments, when read in connection with the accompanying drawings, in which:

FIGS. 1 to 3 are diagrammatic longitudinal sectional views of three different embodiments of the steam generator constructed in accordance with the invention.

In the figures, like parts are identified by the same reference numerals.

Referring now to the drawings and first, particularly, to FIG. 1 thereof, there is shown a steam jacket 1 surrounding vaporizer or boiler tubes 2 disposed between an upper tube support plate 3 and a lower tube support plate 4. A water chamber 5 is secured to the upper tube support plate 3, and inlet nipples or connecting pipes 6 for primary water (cooling water of the nuclear reactor) are connected to the water chamber 5. The lower tube support plate 4 is secured to a water chamber 7 from which discharge nipples or connecting pipes 8 for the primary water extend. Bellows-like compensators 9, which afford relative movement between the inlet nipples 6 for the primary water and the steam jacket 1 for the purpose of equalizing varying thermal expansions and which are accessible from the outside, are disposed between the inlet nipples 6 and the steam jacket 1.

Feedwater is supplied through a connecting pipe 10 in direction of the arrow associated therewith in FIG. 1, and is distributed by a toroidal or circular distributor tube 11 suitably formed with holes therein so that the feedwater flows downwardly in direction of the arrow 12 between a cylindrical guide wall 13 and the steam jacket 1. The guide wall 13 is supported by non-illustrated means such as spacer struts, for example, suitably connecting the guide wall 13 to the steam jacket 1. The guide wall 13 terminates below the upper side of the lower tube support plate 4, as viewed in FIG. 1, so that the feedwater flows upwardly thereat in direction of the arrow 14. The feedwater consequently reaches the vaporizer tubes 2 that are traversed by the primary water. The remaining feedwater circulates, moreover, in direction of the arrows 12 and 14. The generated steam flows out of the vaporizer tubes 2 above the surface of the water and travels through an annular gap located between the upper tube support plate 3 and the steam jacket 1 in direction of the arrows 15 through a conventional moisture separator 16 and discharges from the steam generator through the connecting pipes 17.

At the lower part of the steam jacket 1, as viewed in FIG. 1, a waste liquid connecting tube or nipple 18 is located, out of which part of the feedwater containing a concentration of corrosion products is withdrawn and fed to a non-illustrated purifying apparatus. The water chamber 7 and the lower tube support plate 4 with the locations thereof at which the tube ends of the vaporizer tubes 2 are fastened or connected thereto can be inspected with the aid of the connecting pipe 19 after the cover 20, which closes the connecting pipe 19, has been removed. A cover 21 is also provided for the upper tube support plate 3 with the water chamber 5 and is located at the end of a tube extending from the water chamber 5 and out of the steam jacket 1.

The embodiment of the steam generator according to the invention that is shown in FIG. 2 differs from that of FIG. 1 in that a central supply nipple or connecting pipe 6 is provided at the lower end of the steam jacket 1, as seen in FIG. 1, and extends upwardly in the middle of the vaporizer tubes 2 until it reaches the upper tube support plate 3. In order to protect the compensator 9 of the supply nipple 6 of FIG. 2 against deposits, a conventional slide or slip ring seal 22 is mounted on the periphery of the supply nipple 6 in vicinity of the lower tube support plate 4.

In the embodiment of FIG. 3, the discharge connecting pipe or nipple 8 for the primary water extends centrally upwardly starting from the lower tube support plate 4 through the vaporizer tubes 2, the upper tube support plate 3 and the water chamber 5. The compensator 9 is located between the steam jacket 1 and the discharger or outlet connecting pipe 8 for the primary water, in the embodiment of FIG. 3. Supply of the primary water is effected through supply nipples 6 laterally disposed at the steam jacket 1 and extending horizontally through the steam jacket 1 and terminating in the water chamber 5. An inspection cover 23 is provided at the water chamber 7 and is located above the connecting pipe 19.

There are claimed:

1. Steam generator for pressurized-water nuclear reactors having a steam jacket, two horizontally disposed tube support plates, a multiplicity of rectilinear tubes traversed by primary water, the tubes being disposed within the steam jacket secured between the two tube support plates, a compensator for length equalization, and at least one connecting tube for supplying the primary water secured within the steam jacket through the compensator, comprising a water chamber respectively disposed within the steam jacket and adjoining each of the tube support plates, and a guide jacket for circulating feedwater supplied into the steam jacket, the guide jacket being mounted within the steam jacket and having a lower portion extending into a space located between the steam jacket and the lower tube support plate.

2. Steam generator according to claim 1 wherein said water chamber adjoining the lower tube support plate and a lower part of the steam jacket define an intermediate space, and a waste liquid connecting pipe communicates with said intermediate space and extends from the steam jacket.

3. Steam generator according to claim 1 wherein the steam jacket has a uniform diameter over a middle portion thereof that exceeds the diameter of the tube support plates to an extent that annular spaces defined by the tube support plates, on the one hand, and the middle portion of the steam jacket, on the other hand, are formed through which adequate volumes of feedwater and steam can flow.

4. Steam generator according to claim 1 wherein a plurality of parallel-connected connecting tubes for supplying the primary water and a plurality of parallel-connected connecting tubes for discharging the primary water are connected to the steam jacket.

* * * * *